US005771420A

United States Patent [19]

Suzuki et al.

[11] Patent Number: 5,771,420

[45] Date of Patent: Jun. 23, 1998

[54] LIFE DETECTING SYSTEM FOR DETECTING THE USEFUL LIFE OF A PROCESS UNIT

[75] Inventors: Makoto Suzuki; Takemi Yamamoto, both of Nagoya, Japan

[73] Assignee: Brother Kogyo Kabushiki Kaisha, Nagoya, Japan

[21] Appl. No.: 828,347

[22] Filed: Mar. 28, 1997

[30] Foreign Application Priority Data

Apr. 10, 1996 [JP] Japan ..... 8-088181

[51] Int. Cl.[6] ..... G03G 15/00

[52] U.S. Cl. ..... 399/25

[58] Field of Search ..... 399/24, 25

[56] References Cited

U.S. PATENT DOCUMENTS 4,851,875 7/1989 Tanimoto ..... 399/24

5,572,292 11/1996 Chatani et al. ..... 399/25

FOREIGN PATENT DOCUMENTS 61-129661 6/1986 Japan .

*Primary Examiner*—William J. Royer

*Attorney, Agent, or Firm*—Oliff & Berridge, PLC

[57] ABSTRACT

The present invention provides a life detecting system that accurately detects the end of the useful life of a process unit used in electrophotographic printers. The life detecting system comprises a RAM that stores a count of the number of driving pulses generated at an exposure unit and a ROM that stores a predetermined reference count that represents the useful life of the process unit in terms of a driving pulse count. The system indicates that the end of the useful life of the process unit has been reached when it determines that the count stored in the RAM is greater than or equal to the predetermined reference count stored in the ROM.

27 Claims, 4 Drawing Sheets

LIFE DETECTING SYSTEM FOR DETECTING THE USEFUL LIFE OF A PROCESS UNIT

BACKGROUND OF THE INVENTION

1. Field of the Invention

This invention relates to a life detecting system for a process unit used in devices that electrophotographically record characters and images on a sheet, such as, for example, laser beam printers and electrostatic printers.

2. Description of Related Art

Printers that print using electrophotographic methods, such as laser beam printers and electrostatic printers, are typically provided with a process unit comprising a photosensitive element, a charger, a developing unit, and a transfer unit. Generally, as the number of printed sheets increases, the surface of the photosensitive element in the process unit either deteriorates or becomes damaged. As a result, the charging characteristics of the photosensitive element degrades. Thus, the quality of the images recorded on the sheet goes down. Accordingly, the process unit should be replaced before poor quality images are recorded. This is typically accomplished by judging when the process unit has reached the end of its useful life.

One method for predicting the useful life of the process unit has a user visually inspect the printed sheet to detect printing defects recorded on the sheet, such as insufficient image density.

In another method, a printing control unit counts the total number of printed sheets and notifies a user to replace the process unit when the number of printed sheets reaches a predetermined number.

Japanese Unexamined Patent Publication No. 61-129661 discloses a device that determines the useful life of a photosensitive element by measuring the exposure time of the photosensitive element and judges the deterioration of the photosensitive element from the exposure time measurement.

However, visually inspecting is disadvantageous because the criteria used to judge the useful life of the process unit depends on the subjective opinion of the user. One user may determine that the process unit has reached its useful life before the actual end of its useful life. Thus, resources are wasted by prematurely replacing the process unit. Alternatively, another user may continue using the process unit after the end of its useful life, resulting in poor quality printouts and damage to the printer.

Counting the number of printed sheets is disadvantageous because the degree of deterioration of the photosensitive element for a given number of sheets varies with the sizes of the images printed out (i.e., how large an area of the photosensitive element is exposed to the laser). Therefore, the useful life cannot be accurately determined simply by counting the number of printed sheets.

Measuring the exposure time of the photosensitive element in the process unit is disadvantageous because the deterioration of the photosensitive element due to cleaning operations is not taken into account, these cleaning operations include, for example, smoothing the developer remaining on the surface of the photosensitive element. Thus, the useful life is not accurately determined.

SUMMARY OF THE INVENTION

This invention provides a life detecting system that allows a user to accurately determine the useful life of a process unit used in electrophotographic printers, such as laser beam printers.

A first preferred embodiment of the life detecting system of this invention is usable with a process unit that comprises a latent image recording medium for recording a pixel-based latent image and a latent image former for forming a latent image on the latent image recording medium, developing the latent image recorded on the latent image recording medium, and transferring the image to a printing medium.

The first preferred embodiment of the life detecting system comprises a driving pulse counter for counting driving pulses generated in the latent image former and used to form the latent image, a first memory for storing a predetermined value that represents the process unit's useful life in terms of the driving pulse count, and a comparator for comparing the driving pulse count to the predetermined value stored in the first memory.

In the first preferred embodiment, the end of the useful life of the process unit is determined when the comparator determines that the driving pulse count exceeds the predetermined value stored in the first memory. Accordingly, the useful life of the process unit is accurately determined.

A second preferred embodiment of the life detecting system of this invention is usable with a process unit in which the latent image former comprises a laser diode that emits light when the driving pulses are serially input to the laser diode. In the second preferred embodiment, the driving pulse counter sequentially counts the driving pulses input serially to the laser diode. Accordingly, the driving pulse counter can be implemented with an electronically simple structure.

A third preferred embodiment of the life detecting system of this invention is usable with a process unit in which the latent image former uses one of a plurality of different available exposure times for each pixel to smoothly print a sloped line. In the third preferred embodiment, the driving pulse counter adds a value, proportional to the exposure time used by the latent image former, to the count determined by the driving pulse counter. Accordingly, the useful life of the process unit is accurately determined when two or more exposure time settings are available.

A fourth preferred embodiment of the life detecting system of this invention is usable with a process unit that includes a printing density setter for setting the printing density used by the process unit. In the fourth preferred embodiment, the driving pulse counter adds a value, proportional to the printing density set by the printing density setter, to the previous count determined by the driving pulse counter. Accordingly, the useful life of the process unit is accurately determined when the printing density used by the process unit varies.

A fifth embodiment of the life detecting system of this invention is usable with a process unit that includes a cleaning unit for performing cleaning operations on the latent image recording medium. The fifth preferred embodiment further comprises a second memory for storing a second predetermined value in terms of a number of driving pulses. The second predetermined value represents an offset that takes into account the deterioration of the process unit due to cleaning operations. The driving pulse counter adds the second predetermined value stored in the second memory to the previous count determined by the driving pulse counter when the cleaning unit performs a cleaning operation. Accordingly, since deterioration due to cleaning operations is taken into account, the useful life of the process unit is accurately determined.

A sixth preferred embodiment of the life detecting system of this invention is also usable with the process unit including the cleaning unit. The sixth preferred embodiment includes a printing history memory unit and a calculating unit. The printing history memory unit stores the number of driving pulses required to form a latent image on a predetermined area of the latent image recording medium immediately before the cleaning unit starts a cleaning operation. The calculating unit calculates an offset value by multiplying the number of driving pulses stored in the printing history memory unit by a coefficient that represents the degree of deterioration of the process unit. The driving pulse counter adds the offset value calculated by the calculating unit to the previous count determined by the driving pulse counter. Accordingly, the degree of deterioration of the process unit, which varies with the condition of the latent image recording medium immediately before the cleaning operation, is considered in determining the useful life of the process unit.

Each of the first-sixth preferred embodiments of the life detecting system of this invention can also include a notifier for notifying a user of the end of the useful life of the process unit when the comparator determines that the driving pulse count determined by the driving pulse counter exceeds the predetermined value stored in the memory. Accordingly, a user is reliably notified when the end of the process unit's useful life has been reached.

The notifier preferably comprises an actuator and a life indicator. The life indicator, when actuated by the actuator, changes from a first condition to a second condition and maintains the second condition after the change. The actuator actuates the life indicator when the comparator determines that the driving pulse count exceeds the predetermined value. Accordingly, because the life indicator changes from a first condition to a second condition and maintains the second condition after the change, a user is reliably notified of the end of the process unit's useful life.

In a first preferred embodiment of the notifier the actuator comprises a pressing unit. The life indicator comprises a pressure-sensitive color medium that changes color when pressure is applied by the pressing unit. Accordingly, the operation of the notifier is not affected by temperature, moisture or other environmental factors.

In a second preferred embodiment of the notifier the actuator comprises a heat generator. The life indicator comprises a heat-sensitive color medium that changes color when heated by the heat generator. Accordingly, an inexpensive medium is used to notify a user of the end of the process unit's useful life.

In a third preferred embodiment of the notifier, the actuator comprises a light emitter. The life indicator comprises a light-sensitive color medium that changes color when illuminated by the light emitter. Accordingly, since the actuator and the life indicator are not in physical contact with each other, the risk of impact damage is reduced.

These and other features and advantages of this invention are described in or are apparent from the following detailed description of the preferred embodiments.

BRIEF DESCRIPTION OF THE DRAWINGS

The preferred embodiments of this invention will be described in detail, with reference to the following figures, wherein.

DETAILED DESCRIPTION OF PREFERRED EMBODIMENTS

Figure 1:
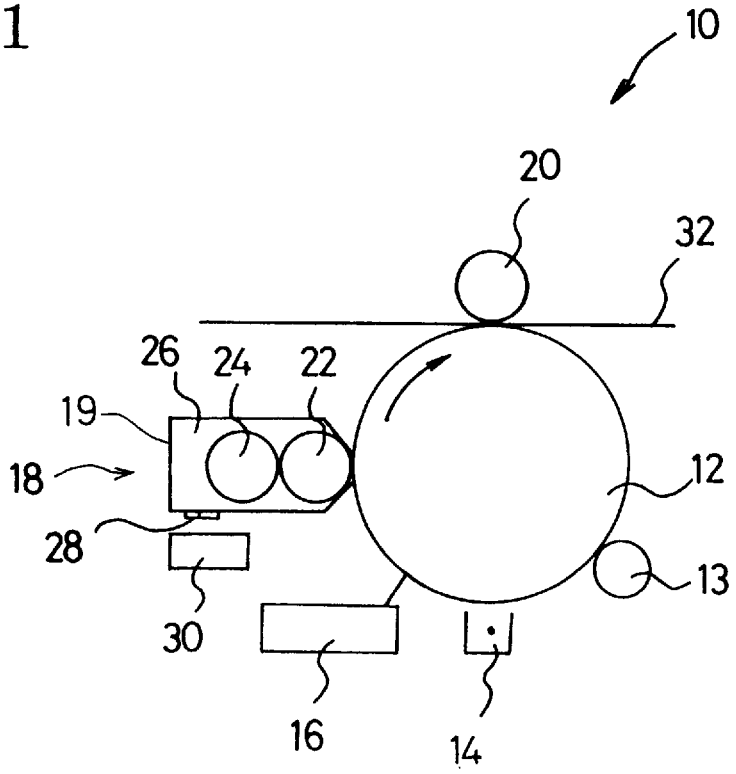
FIG. 1 is a schematic diagram of a process unit incorporating a preferred embodiment of the life detecting system of this invention.

FIG. 1 shows a process unit 10 for use with an electrophotographic printer (not shown) that incorporates the life detecting system of this invention. The process unit 10 includes a cleaning unit 13, a charger 14, a latent image former 16, a developing unit 18, and a transfer unit 20 disposed around a latent image recording medium 12. The latent image recording medium 12 is preferably a photosensitive element. The latent image former 16 is preferably an exposure unit. The cleaning unit 13 is preferably a cleaning roller.

The photosensitive element 12 is preferably formed by applying a photosensitive material, such as organic photoconductor (OPC), to an aluminum drum. The charger 14 is preferably a scorotron charger and is used to uniformly charge the surface of the photosensitive element 12 to a predetermined polarity.

The exposure unit 16 preferably comprises a laser diode that emits light, a polygon mirror that deflects the diode light for scanning the surface of the photosensitive element 12, and a lens that images the diode light onto the surface of the photosensitive element 12. When the photosensitive element 12 is irradiated with the light from the laser diode, an electrostatic latent image that corresponds to the light pattern is formed on the photosensitive element 12.

The developing unit 18 preferably comprises a housing 19, a developing roller 22, a supply roller 24, and a toner box 26. The toner box 26 stores toner for recording images. The supply roller 24 supplies toner discharged from the toner box 26 to the developing roller 22. The developing roller 22 applies the toner supplied from the supply roller 24 to the surface of the photosensitive element 12 to develop the electrostatic latent image formed on the surface of the photosensitive element 12. The developing roller 22 and the supply roller 24 are preferably made of elastic materials, such as urethane or silicon rubber. In addition, the developing roller 22 and the supply roller 24 can be biased as is known in the art.

The transfer unit 20 transfers the toner image formed on the photosensitive element 12 to a sheet 32. The transfer unit 20 is preferably made of elastic materials, such as urethane or silicon rubber, and is biased as is known in the art.

The cleaning unit 13 preferably comprises a cleaning roller preferably made of an elastic material, such as urethane or silicon rubber, that allows the cleaning roller 13 to be biased. When the cleaning roller 13 is biased, any toner remaining on the photosensitive element 12 after the image is transferred to the sheet 32 is removed by the cleaning roller 13.

A notifier for notifying a user of the end of the useful life of the process unit 10 preferably comprises a life indicator 28 fixed to the surface of housing 19 and an actuator 30 positioned opposite the life indicator 28. The life indicator 28 is preferably an irreversible changing medium. In the first preferred embodiment of the notifier, the life indicator is preferably a pressure-sensitive color medium that changes color when pressed, and the actuator 30 preferably comprises a pressing unit, such as an electromagnetic solenoid.

Figure 2:
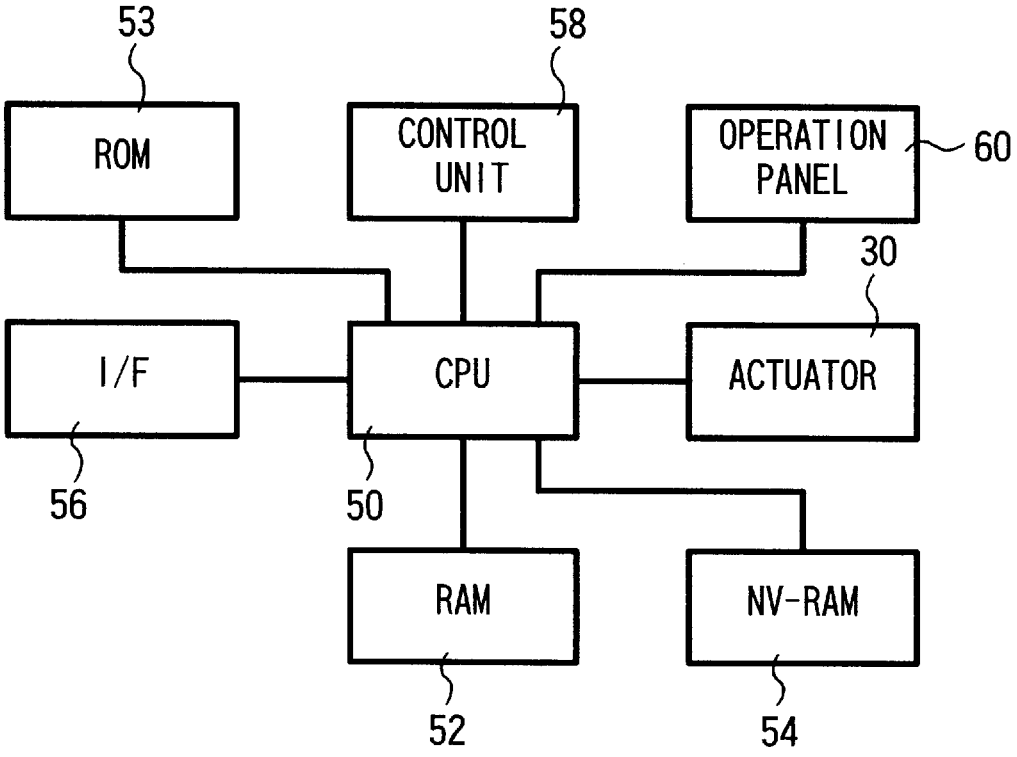
FIG. 2 is a block diagram of a control system used with the life detecting system of this invention.

FIG. 2 shows a block diagram of a control system used with the life detecting system of this invention. The control system comprises a central processing unit (CPU) 50 that is connected to a random access memory (RAM) 52, a read-only memory (ROM) 53, a nonvolatile random access memory (NV-RAM) 54, an interface 56 for transferring data to and receiving data from a personal computer, a control unit 58 for controlling the process unit 10, an operation panel 60 for setting the printing density and the actuator 30. The RAM 52 functions as a driving pulse counter and printing history memory in this invention. The NV-RAM 54 functions as a first memory and a second memory in this invention.

The control unit 58 controls the developing unit 18, the transfer unit 20, the cleaning unit 13, the rotation of the photosensitive element 12, the bias voltage applied to the charger 14, and the laser diode in the exposure unit 16. The NV-RAM 54 stores a dot pulse count that is associated with the useful life of the process unit 10.

The ROM 53 stores a control routine for the control unit 58. The RAM 52 is preferably divided into a first operating area that stores a printing routine and a second operating area that stores a count.

The operation of the process unit 10 incorporating the life detecting system of this invention will now be described with reference to FIGS. 1 and 2.

During normal printing operations, excess toner remaining on the surface of the photosensitive element 12 is removed by the cleaning unit 13. Consequently, the charger 14 is able to charge the surface of the photosensitive element 12 uniformly.

The exposure unit 16 forms an electrostatic latent image on the surface of the photosensitive element 12 with the light from the laser diode. For example, when the surface of the photosensitive element 12 is charged to approximately +800 V, the potential at the areas of the photosensitive element 12 exposed to the diode light drops to approximately +100 V. The resulting potential distribution on the surface of the photosensitive element 12 forms an electrostatic latent image.

The toner supplied from the toner box 26 to the developing roller 22 via the supply roller 24 electrostatically adheres to the low potential areas of the photosensitive element 12. As a result, a toner image is formed on the photosensitive element 12. The toner image is then transferred from the photosensitive element 12 to the sheet 32 by the transfer unit 20. The toner image is fixed onto the sheet 32 with a thermal fixing unit.

Any toner remaining on the photosensitive element 12 after the toner image is transferred is removed by the cleaning roller 13. The toner deposited on the cleaning roller 13 is returned to the photosensitive element 12 by applying a bias voltage of opposite polarity to that applied during cleaning to the cleaning roller 13 during a non-printing cycle. The toner is then reclaimed and recycled by the developing roller 22.

Figure 3:
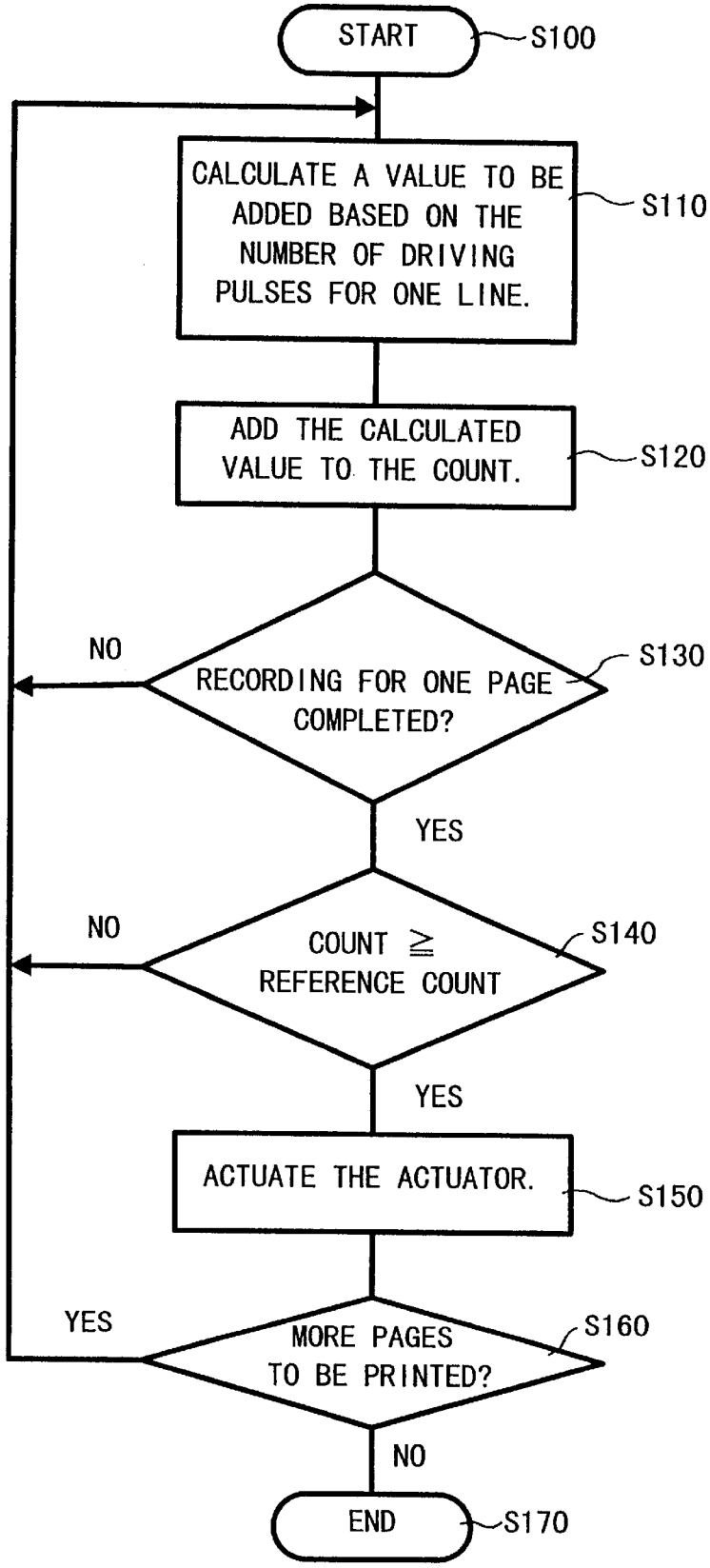
FIG. 3 is a flowchart of a preferred control routine for the life detecting system of this invention.

FIG. 3 shows a preferred control routine for the life detecting system incorporated into the process unit 10. The routine starts at step S100 and proceeds to step S110. In step S110, a value or count equivalent to the number of dot or pixel locations on the photosensitive element 12 irradiated with light is determined by sequentially counting the number of driving pulses input serially to the laser diode when data for one line is transmitted to the exposure unit 16. Control then continues to step S120, where the value calculated at step S110 is added to a count stored in a predetermined area of the RAM 52.

Control continues from step S120 to step S130, where the control system determines if an entire page of the image has been recorded. If an entire page has not been recorded, control returns to step Silo. Thus, steps S110 through S130 are repeated until all the lines in a single page have been recorded. Accordingly, the calculations described above are performed for each line in the image.

If an entire page has been recorded, control continues to step S140, where the control system determines if the count $N_{new}$ is equal to or greater than the predetermined reference count stored in the NV-RAM 54. As explained above, the reference count is derived by defining the end of the useful life of the process unit 10 in terms of the number of laser diode drive pulses needed to print a predetermined number of pixels. If the count is not equal to or greater than the reference count stored in the NV-RAM 54, control returns to step S110 and counting of the laser diode drive pulses continues. Otherwise, control continues to step S150.

In step S150, the control system directs the actuator 30 to press against the life indicator 28 to change the color of the life indicator 28. The color change alerts a user that the process unit 10 has reached the end of its useful life and should be replaced. Control then continues to step S160. In step S160, the control system determines whether additional pages are to be printed. If so, control returns to S110. Otherwise control continues to step S170, where the control routine stops.

Laser beam printers sometimes use two or more different exposure time settings for one pixel to record a sloped line smoothly. In this case, a value proportional to each exposure time is added to the count. For example, if 1 pixel is added to the count for each pixel that is exposed to the light for 40 ns, then 2, 3 or 4 pixels are added to the count for each pixel that is exposed to diode light for 80 ns, 120 ns or 160 ns, respectively. This results in more accurately detecting the end of the useful life of the process unit 10, and reduces the size of the memory area required to store the count. For example, if the useful life of the process unit 10 is equivalent to 10,000 pages when the number of pixels per page is $4700\times6200=2.914\times10^7$ for an A4 page at 600 dpi resolution, the total number of pixels printed during the useful life of the process unit 10 is $2.914\times10^{11}$. The total number of pixels per page is dependent on the size of the paper used, e.g. A4 or 8.5"×11", the margin settings and the resolution of the printer. For example, for an 8.5"×11" page with 0.5 inch total side margins, 1 inch total top and bottom margins and 600 dpi resolution, the number of pixels per page is $4{,}800\times6{,}000=2.88\times10^7$.

The process unit 10 is assumed to reach the end of its useful life when the laser diode has been driven with as many drive pulses as the calculated total number of pixels to be printed. Thus, the calculated total number of pixels to be printed during the useful life of the process unit 10 is stored in NV-RAM 54. This predetermined value, the reference count, can be set using the operation panel 60 or using the personal computer connected via the interface 56. Allocating an area of 5 bytes (40 bits) to the RAM 52 as a memory area for storing the actual count derived in step S110 allows the actual count and the reference count to be easily compared.

Some laser printers include a print density setter for setting different print densities. In this case, the value to be added to the count is preferably changed depending on the printing density selected. For example, for each pixel that is exposed to the light for 40 ns, 80 ns, 120 ns or 160 ns, 1, 2, 3 or 4 pixels, respectively, are added to the count during normal density printing, while 2, 4, 6 or 8 pixels, respectively, are added to the count during higher density printing. Accordingly, the useful life of the process unit 10 is more accurately determined by changing the value added to the count in accordance with the selected printing density.

Generally, the value to be added to the count per line $N_{line}$ is:

$$N_{line}=\Sigma N_a n_a \quad (1)$$

where:

a is the exposure time;

$N_a$ is the value (number of pixels) to be added to the counted count per pixel irradiated for the exposure time a; and $n_a$ is the number of pixels per line for the exposure time a.

The previous count, including all previously recorded lines, is $N_{old}$. Thus, the latest count $N_{new}$ including the latest recorded line, is:

$$N_{new}=N_{old}+N_{line} \quad (2)$$

As discussed above, the cleaning operations performed by the cleaning unit 13 contribute to the deterioration of the photosensitive element 12. The degree of deterioration of the photosensitive element 12 due to one cleaning cycle varies depending on the printing history immediately before the cleaning cycle. The printing history is the number of pixels used for printing the latent image formed on the photosensitive element 12 immediately before the cleaning cycle. Accordingly, the end of the useful life of the process unit 10 can be more accurately determined by taking into account the deterioration of the process unit 10 due to cleaning operations.

Figure 4:
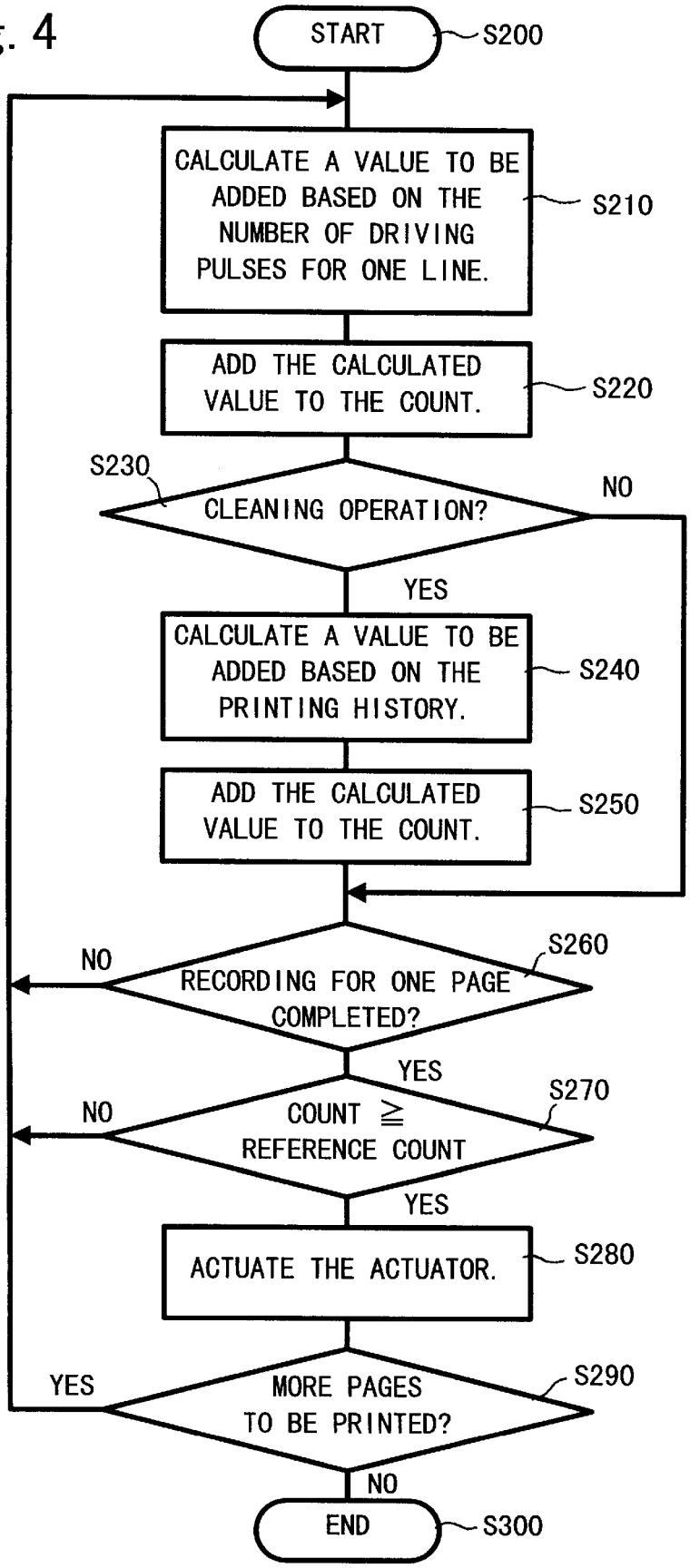
FIG. 4 is a flowchart of a preferred control routine for the life detecting system of this invention that takes into account the effect of cleaning operations.

FIG. 4 shows a control routine for the life detecting that takes into account the effect of the cleaning operations when determining the end of the useful life of the process unit 10.

The routine starts as step S200 and proceeds to step S210. In step S210, a value or count equivalent to the number of dot or pixel locations on the photosensitive element 12 irradiated with the light is determined by sequentially counting the number of driving pulses input serially to the laser diode when data from one line is transmitted to the exposure unit 16. Control then continues to step S220, where the value calculated at step S210 is added to a count stored in the predetermined area of the RAM 52.

In step S230, the control system determines if a cleaning operation is being performed. If a cleaning operation is not being performed, control jumps to step S260. Otherwise, control continues to step S240.

In step S240, a value to be added to the count is calculated based on the printing history of the process unit 10 immediately before the cleaning operation. The printing history immediately before the cleaning operation is stored in the RAM 52. The value to be added to the count is calculated by multiplying the number of printing pixels $N_{pre}$ by a predetermined coefficient b, where b is based on the amount of deterioration that occurs in the process unit 10 due to one cleaning cycle.

Control then continues to step S250, where the valve calculated at step S240 is added to the count. The latest count $N_{new}$ at the completion of a cleaning operation is thus calculated as:

$$N_{new}=N_{old}+(b\times N_{pre}). \quad (3)$$

Control then continues to step S260, where the control system determines if an entire page of the image has been recorded. If an entire page has not been recorded, control returns to step S210. Thus, steps S210 through S260 are repeated until all the lines in a single page have been recorded. Accordingly, the calculations described above are performed for each line in the image.

If an entire page has been recorded, control continues to step S270, where the control system determines if the count $N_{new}$ is equal to or greater than the predetermined reference count stored in the NV-RAM 54. If the count $N_{new}$ is not equal to or greater than the predetermined reference count, control returns to step S210. Otherwise, control continues to step S280, where the control system directs the actuator 30 to press against the life indicator 28 to change the color of the life indicator 28. Control then continues to step S290.

In step S290, the control system determines whether an additional page has tried to be printed. If so, control returns to step S210. Otherwise, control continues to step S300, where the control routine stops.

As shown in FIG. 2, the control system is preferably implemented using a programmed microprocessor or microcontroller and peripheral integrated circuit elements. However, the control system can also be implemented using a ASIC or other integrated circuit, hardwire electronic or logic circuit such as a discrete element circuit, a programmable logic device such as a PLD, PLA, FPGA or PAL, or the like. In general, any device on which a finite state machine capable of implementing the flowcharts shown in FIGS. 3 and 4 can be used to implement the control system.

While this invention has been described with reference to specific embodiments, it is not limited to the specific details set forth above. Various modifications or changes can be made without departing from the scope and spirit of the invention.

For example, although a laser diode and a polygon mirror are used in the exposure unit 16 in the preferred embodiment, a light-emitting diode array may also be used in the exposure unit 16.

In addition, although this invention is described in connection with a laser beam printer, the life detecting system of this invention can be incorporated into any electrostatic printer or magnetic graphics unit.

Further, although a cleaning roller is used as the cleaning unit 13 in the preferred embodiment, other cleaning and toner recycling mechanisms may be used.

In the embodiment that takes into account the deterioration of the process unit 10 due to cleaning operations, the value to be added to the count is calculated based on the printing history immediately before the cleaning operation. However, it is also possible to predetermine an average value that represents the degree of deterioration of the process unit 10 due to one cleaning operation, and store this average value in the ROM 53. The stored average value is then added to the count every time a cleaning operation is performed.

In the preferred embodiment, the end of the useful life of the process unit 10 is indicated using the life indicator 28 and the actuator 30. However, the end of the useful life of the process unit 10 can also be indicated with a display, such as a liquid crystal display or an LED, or with sound, such as an alarm.

In addition, although a pressure-sensitive color medium is used preferably as the life indicator 28 in the preferred embodiment, a heat-sensitive color medium, such as a heat-sensitive paper, or a light-sensitive color medium may also be used.

If a heat-sensitive color medium is used for the life indicator 28, a thermal head or heater is preferably used as the actuator 30. If a light-sensitive color medium is used for the life indicator 28, a light emitter such as a light-emitting diode, is preferably used as the actuator 30.

Accordingly, the preferred embodiments of the invention as set forth above are intended to be illustrative, not limiting. Various changes may be made without departing from the spirit and cope of the invention as defined in the following claims.

What is claimed is:

1. A life detecting system for a process unit comprising a latent image recording medium recording a latent image and a latent image former forming the latent image on the latent image recording medium and transferring the latent image onto a printing medium, the life detecting system comprising:

a driving pulse counter that counts driving pulses generated in the latent image former, the driving pulses used to form portions of the latent image;

a first memory that stores a predetermined value corresponding to a useful life of the process unit;

a comparator that compares a count of the driving pulse counter with the predetermined value; and a notifier that notifies a user of the end of the useful life of the process unit when the comparator judges that the count exceeds the predetermined value;

wherein the notifier comprises:

an indicator having an irreversibly changing medium capable of irreversibly changing from a first indication state to a second indication state, and an actuator that changes the irreversibly changing medium from the first indication state to the second indication state when the comparator judges that the count exceeds the predetermined value.

2. The life detecting system of claim 1, wherein:

the latent image former serially inputs the driving pulses and comprises a laser diode that emits light based on the serial driving pulses; and the driving pulse counter sequentially counts the serial driving pulses input to the laser diode.

3. The life detecting system of claim 1, wherein:

the latent image comprises a plurality of image pixels; and the driving pulse counter adds, for each image pixel, an offset value to the driving pulse count that corresponds to an exposure time used by the latent image former for the corresponding image pixel.

4. The life detecting system of claim 1, further comprising a printing density setter that sets a printing density for the process unit, the driving pulse counter adding an offset value to the driving pulse count that corresponds to the printing density set by the printing density setter.

5. The life detecting system of claim 1, further comprising:

a cleaning unit that cleans the latent image recording medium; and a second memory that stores a second predetermined value corresponding to a degree of deterioration due to cleaning the latent image recording medium;

wherein the driving pulse counter adds the second predetermined value stored in the second memory to the count when the cleaning unit cleans the latent image recording medium.

6. The life detecting system of claim 1, further comprising:

a cleaning unit that cleans the latent image recording medium;

a printing history memory that stores a number of driving pulses required to form a latent image in a predetermined area of the latent image recording medium immediately before the cleaning unit starts cleaning the latent image recording medium; and a calculator that determines a value to be added to the count by multiplying the number of driving pulses stored in the printing history memory by a coefficient corresponding to a degree of deterioration due to cleaning the latent image recording medium;

wherein the driving pulse counter adds the value to the count when the cleaning unit cleans the latent image recording medium.

7. The life detecting system of claim 1, wherein:

the actuator comprises a heat generator; and the irreversibly changing medium comprises a heat-sensitive color medium that changes in color when heated by the heat generator.

8. The life detecting system of claim 1, wherein:

the actuator comprises a pressing unit that applies pressure to the indicator; and the irreversible changing medium comprises a pressure-sensitive color medium that changes color in response to pressure applied by the pressing unit.

9. The life detecting system of claim 1, wherein:

the actuator comprises a light emitter that emits light; and the irreversible changing medium comprises a light-sensitive color medium that changes color when illuminated by the light emitter.

10. A life detecting system for a process unit comprising latent image recording means for recording a latent image and latent image forming means for forming the latent image on the latent image recording means and transferring the latent image onto a printing medium, the life detecting system comprising:

driving pulse counting means for counting driving pulses generated in the latent image forming means, the driving pulses used to form portions of the latent image;

first memory means for storing a predetermined value corresponding to a useful life of the process unit;

comparing means for comparing a count of the driving pulse counting means with the predetermined value; and notifying means for notifying a user of the end of the useful life of the process unit when the comparing means judges that the count exceeds the predetermined value;

wherein the notifying means comprises:

indicating means having an irreversibly changing medium capable of irreversibly changing from a first indication state to a second indication state; and actuating means for changing the irreversibly changing medium from the first indication state to the second indication state when the comparing means judges that the count exceeds the predetermined value.

11. The life detecting system of claim 10, wherein:

the latent image forming means serially inputs the driving pulses and comprises a laser diode that emits light based on the serial driving pulses; and the driving pulse counting means sequentially counts the serial driving pulses input to the laser diode.

12. The life detecting system of claim 10, wherein:

the latent image comprises a plurality of image pixels; and the driving pulse counting means adds, for each image pixel, an offset value to the driving pulse count that corresponds to an exposure time used by the latent image forming means for the corresponding image pixel.

13. The life detecting system of claim 10, further comprising printing density setting means for setting a printing density for the process unit, the driving pulse counting means adding an offset value to the driving pulse count that corresponds to the printing density set by the printing density setting means.

14. The life detecting system of claim 10, further comprising:

cleaning means for cleaning the latent image recording means; and second memory means for storing a second predetermined value corresponding to a degree of deterioration due to cleaning the latent image recording means;

wherein the driving pulse counting means adds the second predetermined value stored in the second memory means to the count when the cleaning means cleans the latent image recording means.

15. The life detecting system of claim 10, further comprising:

cleaning means for cleaning the latent image recording means;

printing history memory means for storing a number of driving pulses required to form a latent image in a predetermined area of the latent image recording means immediately before the cleaning means starts cleaning the latent image recording means; and determining means for determining a value to be added to the count by multiplying the number of driving pulses stored in the printing history memory means by a coefficient corresponding to a degree of deterioration due to cleaning the latent image recording means;

wherein the driving pulse counting means adds the value to the count when the cleaning means cleans the latent image recording means.

16. The life detecting system of claim 10, wherein:

the actuating means comprises a heat generator; and the irreversibly changing medium comprises a heat-sensitive color medium that changes in color when heated by the heat generator.

17. The life detecting system of claim 10, wherein:

the actuating means comprises pressing means for applying pressure to the indicating means; and the irreversible changing medium comprises a pressure-sensitive color medium that changes color in response to pressure applied by the pressing means.

18. The life detecting system of claim 10, wherein:

the actuating means comprises light emitting means for emitting light; and the irreversible changing medium comprises a light-sensitive color medium that changes color when illuminated by the light emitting means.

19. A method of detecting the useful life of a process unit comprising a latent image recording medium recording a latent image and a latent image former forming the latent image on the latent image recording medium and transferring the latent image onto a printing medium, the method comprising:

counting a number of driving pulses generated in the latent image former to generate a corresponding count value, the driving pulses used to form portions of the latent image;

comparing the count value to a predetermined value; and notifying a user of the end of the useful life of the process unit when the count exceeds the predetermined value;

wherein notifying the user of the end of the useful life of the process unit comprises changing an irreversibly changing medium from a first indication state to a second indication state when the count exceeds the predetermined value.

20. The method of claim 19, further comprising:

serially inputting the driving pulses to the latent image former; and sequentially counting the serial driving pulses.

21. The method of claim 19, wherein the latent image comprises a plurality of image pixels, the method further comprising adding, for each image pixel, an offset value to the count value that corresponds to an exposure time used by the latent image former for the corresponding image pixel.

22. The method of claim 19, further comprising:

setting a printing density for the process unit; and adding an offset value to the count value that corresponds to the printing density.

23. The method of claim 19, further comprising:

cleaning the latent image recording medium; and adding a second predetermined value, corresponding to a degree of deterioration due to cleaning the latent image recording medium, to the count when the latent image recording medium is cleaned.

24. The method of claim 19, further comprising:

cleaning the latent image recording medium;

determining a number of driving pulses required to form a latent image in a predetermined area of the latent image recording medium immediately before the latent image recording medium is cleaned;

determining a value to be added to the count by multiplying a number of driving pulses required to form a latent image in a predetermined area of the latent image recording medium immediately before the latent image recording medium is cleaned by a coefficient corresponding to a degree of deterioration due to cleaning the latent image recording medium; and adding the value to the count value when the latent image recording medium is cleaned.

25. The method of claim 19, wherein the irreversibly changing medium is a heat-sensitive color medium and changing the irreversibly changing medium comprises heating the heat-sensitive color medium when the count exceeds the predetermined value.

26. The method of claim 19, wherein the irreversibly changing medium is a pressure-sensitive color medium and changing the irreversibly changing medium comprises applying pressure to the pressure-sensitive color medium when the count exceeds the predetermined value.

27. The method of claim 19, wherein the irreversibly changing medium is a light-sensitive color medium and changing the irreversibly changing medium comprises illuminating the light-sensitive color medium when the count exceeds the predetermined value.

* * * * *